US006428285B2

(12) United States Patent
Breuer et al.

(10) Patent No.: US 6,428,285 B2
(45) Date of Patent: Aug. 6, 2002

(54) HYDRAULIC DELIVERY DEVICE

(75) Inventors: Peter Breuer, Friedrichsdorf; Van Doan Nguyen; Hans-Jürgen Lauth, both of Neu-Anspach; Randolf Körtge, München; Martin Jordan, Bad Homburg; Volker Seipel, Bensheim; Christof Lausser, Friedrichsdorf, all of (DE)

(73) Assignee: LuK Fahrzeung-Hydraulik GmbH & Co. KG, Bad Homburg (DE)

( * ) Notice: Subject to any disclaimer, the term of this patent is extended or adjusted under 35 U.S.C. 154(b) by 0 days.

(21) Appl. No.: 09/808,869

(22) Filed: Mar. 15, 2001

Related U.S. Application Data

(62) Division of application No. 09/339,302, filed on Jun. 23, 1999, now Pat. No. 6,227,816.

(30) Foreign Application Priority Data

| | | |
|---|---|---|
| Jun. 24, 1998 | (DE) | 198 30 002 |
| Jun. 24, 1998 | (DE) | 198 30 005 |
| Jun. 24, 1998 | (DE) | 198 34 119 |
| Jun. 24, 1998 | (DE) | 198 30 001 |
| Jul. 29, 1998 | (DE) | 198 34 117 |
| Oct. 31, 1998 | (DE) | 198 34 118 |
| Oct. 31, 1998 | (DE) | 198 50 240 |

(51) Int. Cl.[7] ..... F04B 49/00; F04B 23/00; F16D 31/02

(52) U.S. Cl. ..... 417/297; 417/302; 417/307; 417/440; 60/468

(58) Field of Search ..... 417/297, 302, 417/307, 440; 60/468

(56) References Cited

U.S. PATENT DOCUMENTS

| | | | | |
|---|---|---|---|---|
| 4,138,204 A | * | 2/1979 | Bruguera | 417/300 |
| 4,240,255 A | * | 12/1980 | Benilan | 60/453 |
| 4,681,517 A | * | 7/1987 | Schulz | 417/300 |
| 5,685,332 A | * | 11/1997 | Overdiek et al. | 137/503 |

* cited by examiner

*Primary Examiner*—Charles G. Freay
*Assistant Examiner*—Timothy P. Solak
(74) *Attorney, Agent, or Firm*—Darby & Darby

(57) ABSTRACT

The invention relates to a hydraulic delivery device with a displacement unit which delivers a medium from a suction connection under output pressure to a pressure connection, connectable with a consumer, and under consumer pressure, and a regulating device for setting and/or limiting a volume flow delivered by the delivery device.

20 Claims, 8 Drawing Sheets

HYDRAULIC DELIVERY DEVICE

CROSS REFERENCE TO RELATED APPLICATION

This application is a divisional application of U.S. patent application Ser. No. 09/339,302, now U.S. Pat. No. 6,227,816, filed on Jun. 23, 1999, which is hereby incorporated by reference in its entirety.

FIELD OF THE INVENTION

The invention relates to a hydraulic fluid delivery or circulation device, such as a pump, that is structurally and thermodynamically efficient, and a method for installing the same.

BACKGROUND OF THE INVENTION

The invention relates to a hydraulic fluid delivery or circulation device (such as a pump) with a displacement unit mounted in a housing and set in rotation through a drivable shaft unit and which comprises a rotor mounted rotationally secured on the shaft in a pump chamber, and with means which during rotation of the rotor produce at least a first region (suction region) with increasing volume and at least a second region (pressure region) with reducing volume, wherein the first region is connected to a suction connection of the delivery device and the second region is connected to a pressure connection of the delivery device.

Hydraulic delivery devices of the above kind are known. These are formed for example as vane pumps, locked vane pumps, rotary piston pumps or the like. It is known to use delivery devices of this kind in power steering devices, auxiliary braking devices or the like in motor vehicles wherein hydraulic oil is pumped out of a tank to a hydraulic consumer with an attendant increase in pressure.

It is likewise known for the pump chamber to be defined by surfaces which are aligned radially relative to the shaft and abut the rotor in pressure-tight manner, and for the pump to have communicating ducts to the at least first and second regions and to have a flow regulator arrangement for regulating the volume flow of the delivery device.

It is also known to drive the delivery device through an internal combustion engine of the motor vehicle wherein a speed of the rotor of the delivery device is changed in accordance with the rotational speed of the combustion engine of the vehicle. The delivery device then produces a volume flow which fluctuates in dependence on the speed of the internal combustion engine and thus the speed of the delivery device. In order to establish a substantially constant maximum volumetric flow at a consumer, flow regulator arrangements are known which are integrated in the delivery device and by means of which a booster connection from a pressure region to a suction region of the delivery device can be released. A number of guide paths (ducts) are hereby established inside a housing of the delivery device which have to be coupled in sealed manner to the pressure or suction regions of the displacement unit.

It is further known to journal the shaft of the delivery device in bearing regions of the housing. As a result of the pressure-tight guidance of the rotor inside the pump chamber it is necessary to provide a bearing for the shaft with the smallest possible bearing clearance and at the same time to mount the shaft pressure-tight using the fewest possible individual parts.

Furthermore the invention relates to a hydraulic delivery device having a displacement unit mounted in a first part of a housing and comprising a rotor which can be set in rotation through a drivable shaft, and with a cover for closing the first housing part as well as with a holder for the delivery device connected to the cover.

The first housing part can be closed by a cover on which a holder for the delivery device is screwed. As a result of this type of connection the cover which in known delivery devices is made from aluminum and is usually made by the pressure die casting method, is relatively large so that a correspondingly large installation space has to be prepared for the delivery device. This is disadvantageous particularly when using the delivery device in connection with a vehicle since here the delivery device is accommodated for example in the engine compartment in which the space available for the delivery device is only very small.

The invention further relates to a hydraulic delivery device with at least one displacement unit mounted in a housing wherein the displacement unit is connected to a suction connection and to a pressure connection of the delivery device, and the suction connection is connectable to a source, more particularly a tank, supply container, reservoir or the like of a medium to be delivered, through a pipe fitting which can be connected pressure-tight to the suction connection.

Furthermore the invention relates to a method for assembling a delivery device wherein a pipe fitting which engages on a housing of the delivery device and is connected pressure-tight to a suction connection can be positioned for connecting with a pipeline leading to a source of the medium which is to be delivered.

The displacement unit mounted in the housing sucks in the oil through a connecting pipe, by way of example a flexible pressure hose, and delivers this through an increase in pressure to the power steering. A connection between the suction connection of the delivery device and the connecting pipe is produced through a pipe union onto which the connecting pipe can be pushed. It is already known to make the pipe union of plastics. A connection between the pipe union and the housing of the delivery device is made so that the pipe union engages in a blind opening wherein an external circumference of the pipe union corresponds substantially to an inner circumference of the blind opening, and the blind opening has at least one radially inwardly pointing projection which engages in a corresponding recess of the pipe union. Axial fixing of the pipe union is hereby achieved. In addition a sealing device is provided between the housing and pipe union to allow a pressure-tight connection.

Through a snap-fitting or detent connection between the pipe union and the housing of the hydraulic delivery device the pipe union can be turned in the blind opening after the hydraulic delivery device has been fitted, for example in the engine chamber of a motor vehicle. It is hereby possible to align the pipe union in order to find the best possible position for connecting the connecting pipe to a tank which contains a medium which is to be delivered. With the known hydraulic delivery device it is a disadvantage if the pipe union can turn inside the blind hole once fitting has taken place. This can lead for example through the appearance of vibrations during use of the hydraulic delivery device to a distortion of the pipe union so that a connection between the pipe union and connecting pipe to the tank can leak or even come undone in an extreme case.

The invention further relates to a hydraulic delivery device having a displacement unit which delivers a medium from a suction connection standing under the output pressure to a pressure connection connectable with a consumer and standing under the consumer pressure, and a regulating device for adjusting or restricting a volume flow conveyed by the delivery device. In the sense of the invention output pressure is to mean suction intake pressure, input pressure or the like which as a rule is smaller than or equal to atmospheric pressure.

Delivery devices of this kind are normally driven by the internal combustion engine so that with a fluctuating speed of an output shaft of the combustion engine the pump speed is likewise subject to fluctuation. Through the fluctuating pump speed a variable volume flow is set by means of the hydraulic delivery device and likewise rises as the pump speed increases. A consumer connected to the pump requires per se only a certain maximum volume flow so that too much volume flow is set by the pump at high speeds. It is known here to provide the pump with a flow regulating valve which regulates a volume flow to a consumer by releasing an outflow channel from a pressure side to a suction side of the pump.

It is known to equip flow regulating valves of this kind with an additional throttle function. To this end a valve piston of the flow control valve has an axial projection which can be passed through a fixed orifice. The free through-flow cross-sectional area of the orifice is adjusted according to the position of the valve piston. This produces an additional throttling of the volume flow which is dependent on the flow regulating piston. The drawback here is that the throttle function is linked to the function of the flow regulating valve so that this likewise throttles dependent on the path of the flow regulating valve. Furthermore a throttle function of this kind is dependent on the pressure in the pressure collecting chamber of the delivery device (operating pressure) since the flow regulating valve is regulated by a difference in pressure between the pressure in the pressure collecting chamber of the delivery device and the consumer pressure. Furthermore there is the drawback that through the combination of the flow regulating valve with the throttle a relatively expensive assembly is required which has to be carried out with great care in order to be able to set exact volume flow characteristics. The flow regulation and throttling must be matched precisely with each other in order to be able to set a desired volume flow characteristic of the hydraulic delivery device.

SUMMARY OF THE INVENTION

The object of the invention is therefore to provide a hydraulic delivery device which compared with the prior art requires less structural space, is simple to construct, requires fewer component parts and furthermore helps in reducing the fuel consumption of the vehicle fitted with same.

According to the invention this is achieved by means of a hydraulic delivery device in that the pump chamber is defined on its one side by a plate which produces a hydraulic control function of the hydraulic delivery device, a sealing device for sealing regions of the delivery device which are under different pressures and an axial positioning of the shaft after fitting and centering the plate. Thus advantageously with a single component part a seal is possible between the different functional regions of the delivery device wherein at the same time a precision bearing of the shaft and its sealing is produced substantially free of axial clearance. Through the plate provided according to the invention (hereinafter called the control plate) a compact construction of the delivery device is achieved which consists of few individual parts, is easy to fit and can thus be manufactured cost-effectively.

In a preferred embodiment of the invention it is proposed that the control plate has a through hole through which the shaft is guided, and the through hole preferably has design features which correspond with those of the shaft to form an axial stop for the shaft. It is hereby readily possible to form a defined stop for the shaft which allows an exact axial alignment of the shaft. This is thus secured against axial displacement and can more or less not fall out of the opening provided in the housing of the delivery device for receiving the shaft. Furthermore additional component parts such as spring rings or tapered discs are unnecessary which reduces the weight and costs.

In a further preferred embodiment of the invention it is proposed that the plate has a radially aligned surface which bears flat against a likewise radially aligned surface of the housing and hereby undertakes the sealing function between different channels or bores opening into the surface of the housing in which different functional elements, more particularly flow control valve, pressure relief valve and main flow throttle, are arranged, as well as seals openings standing under different pressures. An optimum seal can thus be readily produced between the individual regions of the delivery device, particularly when the surface of the plate is pressed under hydraulic pressure against the surface of the housing. The plate is hereby biased indirectly with the hydraulic pressure through a pressure plate.

In a further preferred embodiment of the invention it is proposed that the plate has apertures or recesses forming suction kidneys or pressure kidneys respectively, more particularly also a control pressure bore provided in a pressure cell for a main flow throttle piston adjoined by the highest pressure produced in the delivery device, whereby the other recesses undertake the connection of the displacement unit to the suction or pressure channels or regions of the delivery device. Several control functions of the hydraulic delivery device can hereby be easily achieved by means of the plate through a defined configuration of the recesses and openings.

A further preferred design of the invention is produced in that the full-length opening has an approximately elliptical cross-section wherein a rotary axis of the shaft coincides with a center point of a semi-circular shaped area of the full-length opening after fitting and centering the plate, and a bead positioned coaxial to the rotary axis forms a ring step for receiving the guide section.

An embodiment is likewise preferred wherein the surface of the plate seals the suction kidneys and the pressure kidneys of the delivery device from each other.

According to the invention the plate is pressed on the valve side indirectly (through a pressure plate on the cover side and a spacer ring) hydraulically against the housing part through an operating pressure of the delivery device, whereby the plate has a ring groove through which the under vane areas on the rotor are biased with pressurized medium.

Furthermore it is an object of the invention to provide a hydraulic delivery device which has a simple compact construction as well as is simple to fit, has larger pressure chambers and/or smaller external dimensions and where applicable has reductions in weight.

This is achieved by a hydraulic delivery device wherein the cover and the holder are in one piece or connected together secured against rotation through a screw and a projection engaging in an opening. By omitting the screw connection it is possible to provide a compact structure so that a delivery device can be achieved which only requires a small installation space whilst its weight is reduced.

Furthermore this eliminates the costs of fitting the holder and those for the screw connection which is required with the known delivery device to fix the holder on the cover.

In an advantageous embodiment of the delivery device the cover and/or the holder are produced by the deep drawing method. Through the thin-walled cover the structural space saved is used to enlarge the pressure chamber of the delivery device and/or to design it with better flow properties whereby the load absorption can be reduced. The cover and/or the holder are made in one or more moves from a sheet metal which consists for example of steel, aluminum or an aluminum alloy. The manufacture of the cover and/or the holder through deep drawing is possible and cost-effective since additional processing is no longer necessary.

Thus compared to the pressure die cast aluminum covers, structural space is saved here which produces flow favorable pressure chambers and thus better degrees of efficiency. Furthermore the thinner-walled steel cover is lighter than a thick-walled cast aluminum cover despite the higher specific material weight.

A further advantageous embodiment is produced in that the cover is formed pot-shaped and produces a closed pressure collecting chamber with the first housing part.

According to the invention in the fitted state the cover applies axial contact pressure on the displacement unit through at least a first seal.

According to a further embodiment the pressure collecting chamber is sealed from the atmosphere through at least a second seal which in the fitted state of the cover is pressed against the first housing part.

The invention is further concerned with the task of producing a hydraulic delivery device of the generic type and providing a method for fitting the delivery device wherein a secure connection remains guaranteed between the pipe union and a connecting pipe on one side and the pipe union and the housing of the delivery device on the other side.

According to the invention this is achieved through a hydraulic delivery device wherein the pipe union can be fixed radially and axially in the blind opening by means of external fastening. Thus a relative movement between the pipe union and the housing can be avoided so that the pipe union retains its desired position. A mechanical strain on the connecting points between the pipe union and connecting pipe is hereby avoided so that the pipe union cannot cant relative to the connecting pipe. It is hereby possible at any time, even with mechanical strain for example through vibrations, to guarantee the tightness and reliability of the connecting point between the pipe union and the connecting pipe.

In a preferred embodiment of the invention it. is proposed that the fixing means is a self-tapping screw whose thread circumference partially cuts a wall of the pipe union. After positioning the pipe union the screw can hereby be tightened by means of a tool whereby the self-tapping thread engages in areas in the sleeve of the pipe union and thus displaces the material of the pipe union in part. A simple but secure axial and radial fixing of the pipe union is hereby achieved.

Particularly when a bore holding the fixing screw runs perpendicular to the blind opening receiving the pipe union, maximum holding force can be applied to fix the pipe union axially and radially.

In another preferred embodiment of the invention it is proposed that the fixing means are formed by at least one displaced material area of the housing section enclosing the pipe union. After positioning the pipe unit the material of the housing can hereby be displaced by suitable tools in defined manner so that this material is forced into a recess preferably provided on the pipe union so that axial and radial securement of the pipe union is produced at the same time.

It is particularly preferred if as pipe union a plastics pipe union is used which consists of a polyimide or a polyamide with a proportion of glass fibers which preferably amounts to between 30 and 60% in the case of polyamide and 10% in the case of polyimide. The pipe union which is made of this plastics is hereby on the one hand relatively temperature-resistant and on the other in particular has the required strength to allow the material of the housing of the delivery device which normally consists of pressure cast aluminum to displace into a corresponding recess without damaging the pipe union. Many other plastics are unsuitable for such flanging processes.

Furthermore this is achieved through a method with the said features in that after fitting the delivery device and connecting the pipe union to a connecting pipe leading to a tank, the pipe union is fixed. It is advantageously possible during fitting to retain a certain flexibility through the ability of the pipe union to rotate on the housing so that a connection between the pipe union and the connecting pipe can be produced in optimum manner. Only after this connection has been made is the pipe union fixed so that a subsequent loosening or release of the pipe union, and thus of the connecting point between the pipe union and connecting pipe, which may arise particularly during use of the hydraulic delivery device, is ruled out. The pipe union is preferably fixed by displacing either the material of the pipe union and/or the material of the housing in part so that at least a rear cut section is formed between the pipe union and the housing.

A further preferred embodiment of the invention is produced in that the bore runs at an angle of 90 degrees to an axis of rotation of the pipe union.

A center axis of the bore thereby preferably runs outside of the blind opening.

In a preferred embodiment a collar of the pipe union engages in a ring groove of the housing, and a bead of the housing engaging round the ring groove is deformable at least in part over the collar.

According to the invention the collar has over its circumference several recesses, in particular symmetrically spread out, into each of which a section of the bead can be deformed.

The recesses are preferably formed like segments of a circle.

The invention is further concerned with providing a hydraulic delivery device of the generic type wherein different volume flow characteristics can be readily achieved in dependence on a speed of a rotor of the delivery device and independent of the position of the flow regulator piston. Furthermore no additional build up of pressure is to be produced to operate a throttle piston.

According to the invention this is achieved through a hydraulic delivery device in that a pressure collecting chamber of the delivery device is connected to the pressure connection of the delivery device through a variable throttle device which operates independently of an operating pressure in the pressure collecting chamber of the delivery device. A volume flow regulation can thereby be produced which is substantially independent of the pressure prevailing in the pressure collecting chamber (work pressure).

Particularly if as is preferred the throttle device is a valve assembly which influences in dependence on a differential pressure between the consumer pressure of the delivery device and a pressure inside a cell in front of a pressure kidney of the displacement unit a free passage cross-section of a connection between the pressure collecting chamber of the delivery device and the pressure connection of the delivery device connected to the consumer, the adjusting differential pressure, which is determined in particular by the speed of the pump, can be used to regulate the volume flow of the delivery device. Thus a regulation is possible which is substantially independent of the pressure in the pressure collecting chamber since to regulate the valve assembly substantially the differential pressure between the consumer pressure and the pressure built up in a cell inside the pump in front of a pressure kidney is used. This differential pressure is used more or less for influencing the volume flow of the consumer so that a reduction in the volume flow (consumer flow) adjoining the pressure connection of the delivery device is possible and an influence, more particularly a reduction, of the characteristic line is possible. This pressure inside the cell is more or less the maximum pressure which arises in the actual pump so that the degree of efficiency is better than when using other pressures for regulating purposes.

In a preferred embodiment of the invention it is proposed that the valve assembly has a valve piston mounted axially displaceable in a bore. The valve piston can be biased on the one side with the pressure prevailing in a cell prior to the oil outlet through a pressure kidney of the delivery device, and on the other side with the consumer pressure and the force of a spring element wherein a control device of the valve piston varies the free through-flow cross-sectional area to the pressure connection of the delivery device in dependence on the differential pressure. Valve devices known per se from flow regulating valves can hereby be applied to the design of a variable main flow throttle which is substantially independent of the operating pressure of the delivery device. Particularly when the valve piston has a regulating pin which engages through an opening of a fixed orifice, and an outer contour of the regulating pin has an axially changing contour in the area of movement of the orifice, it is possible through a simple displacement of the valve piston as a result of the differential pressure between the pressure in the pressure kidney and the consumer pressure in the pressure collecting chamber of the delivery device to change the through-flow cross-sectional area of the orifice. A contour of the regulating pin which tapers conically for example and/or widens out conically varies the free through-flow cross-sectional area. Since the position of the valve piston and thus of the regulating pin to the fixed orifice is dependent on the pressure prevailing in the cell in front of the pressure kidney, this in turn being dependent on the speed of the delivery device, different characteristics independent of the operating pressure can be readily set in dependence on the speed of the delivery device.

A further preferred design is produced where the orifice is formed in a sleeve which is pressed into the bore.

According to the invention the regulating pin is supported on a spring plate on which the spring element engages which on the other side is supported on a base of the bore.

In a preferred embodiment the spring element is supported on the valve piston on one side and on the orifice sleeve on the other.

BRIEF DESCRIPTION OF THE DRAWINGS

The invention will now be explained in further detail by way of an embodiment shown in the drawings in which.

DETAILED DESCRIPTION OF THE DRAWINGS

Figure 1:
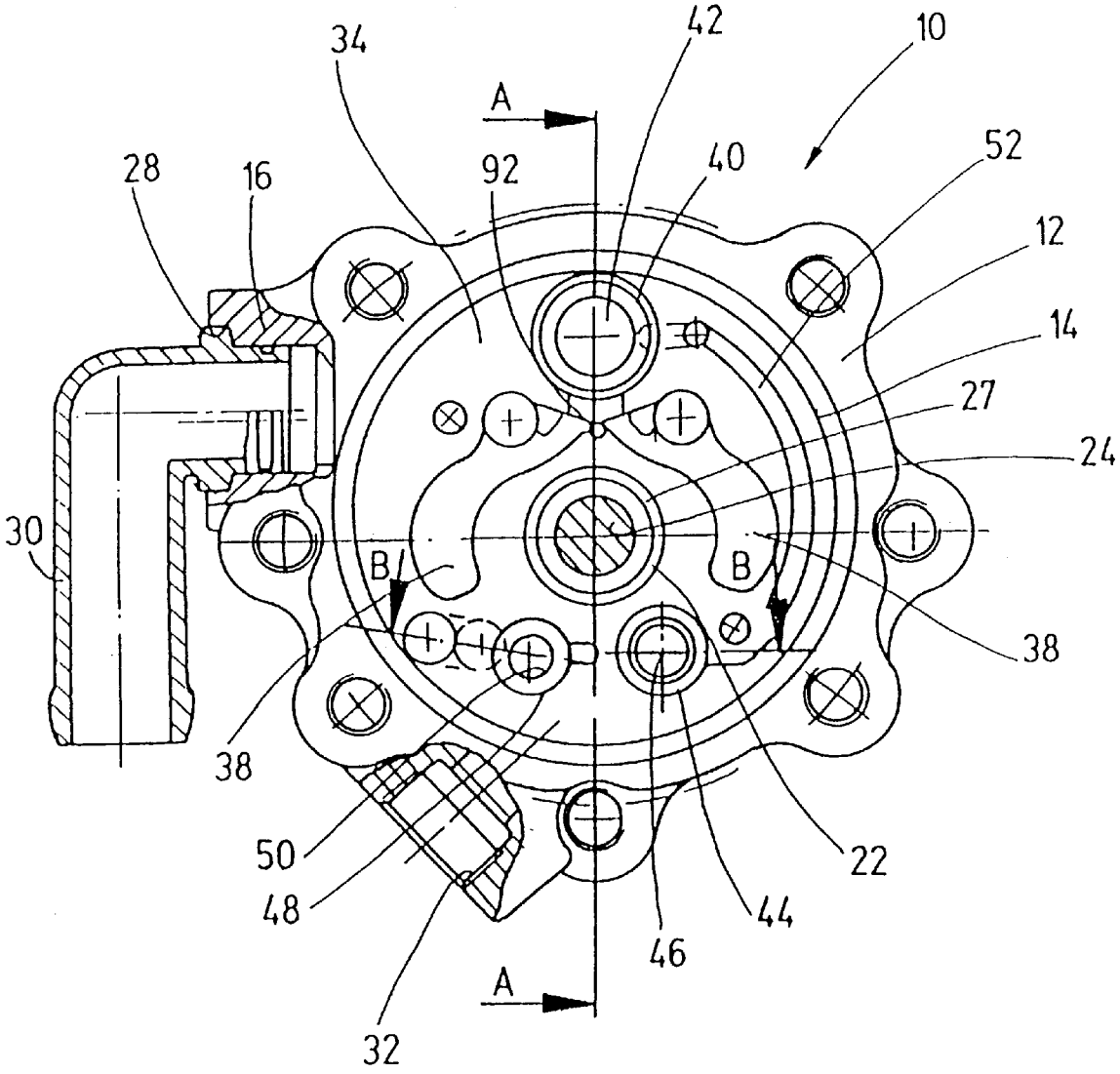
FIG. 1 is a plan view of an opened hydraulic delivery device.

FIG. 1 shows a hydraulic delivery device 10. The hydraulic delivery device 10 has a housing 12 inside which a pump chamber 14. To form the pump chamber 14, a first housing part 16 is closable by a cover 18 (FIG. 2), the cover 18 being formed substantially pot-shaped to produce pump chamber 14. A connection between the housing part 16 and the cover 18 is made by connecting elements 20. The housing part 16 has a through bore opening 22 to receive a shaft 24. The shaft 24 projects beyond the housing part 16 and supports a rotor 26 mounted rotationally secured on the shaft 24. The rotor 26 has radially aligned slits in which vanes are radially movable. Within the scope of the present description further details are not provided for the structure and function of a delivery device 10 in the form of a vane pump since these are generally known.

The shaft 24 is guided inside the housing part 16 in a bearing bush 27. The housing 12 has a suction connection 28 which can be connected to a tank through a pipe elbow 30. Furthermore the housing has a pressure connection 32 to which a hydraulic consumer, such as for example a power steering device of a motor vehicle, can be connected. The housing part 16 has a substantially flat surface 34 which is aligned radially to the axis of rotation 36 of the shaft 24. Ducts 38 arranged symmetrically relative to a section line A—A open into the surface 34 and communicate with the suction connection 28. A bore 40 in which a flow regulating valve 42 is mounted, a bore 44 inside which a pressure relief valve 46 is mounted and a bore 48 inside which a variable main flow throttle 50 is mounted all open at the surface 34. A groove 52 which opens toward the surface 34 connects a spring chamber of the flow regulating valve 42 to the pressure relief valve 46.

Figure 2:
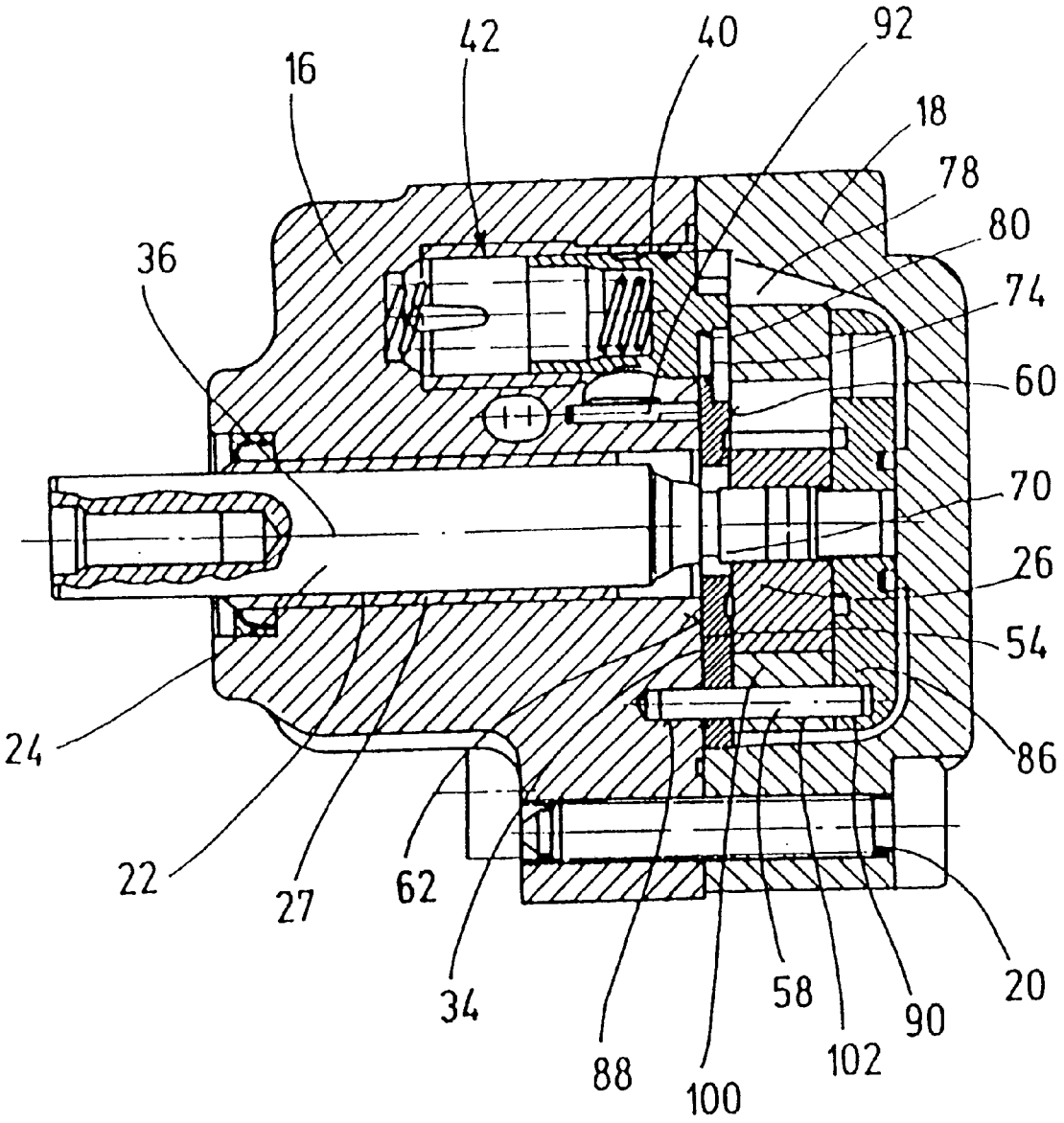
FIG. 2 is a sectional view through the delivery device according to FIG. 1

A plate 54 lies against the surface 34 (FIG. 2). The plate 54 consists for example of a nitrated steel, a sintered metal, a surface-coated steel or a special aluminum alloy. The plate 54 undertakes central functions for the delivery device 10, as will be explained in further detail with reference to FIG. 2 and the illustration of the plate 54 in FIG. 3. The thickness of the plate 54 is such that, with the cover 18 fitted onto the housing part 16, the plate 54 sealingly adjoins the rotor 26. The plate 54 is mounted rotationally secured, that is it is immovable. To this end the plate 54 has locators 56 (FIG. 3) for fastening pins 58 which are mounted on the housing 12, and which engage in corresponding recesses in the housing 12. Through the substantially diametrically opposed arrangement of the recesses 56 a self-adjusting centering positioning of the plate 54 in the housing 12 of the delivery device 10 becomes possible at the same time. Faulty fitting is hereby eliminated.

Through the locally fixed fitting of the plate 54 a surface 60 of the plate 54 forms at the same time a running surface for the rotor 26 or for the radially aligned and edges of the vanes which are movably mounted in the rotor 26. During operation of the delivery device 10, these components are guided rotating along the surface 60 of the plate 54. The surface 62 of the plate 54 opposite the surface 60 lies flat against the surface 34 of the housing part 16.

The plate 54 has a cental through opening 64 (FIG. 3) which has an approximately elliptical cross-section. The cross-section is formed by a semi circle 69 which—at the top in the illustration—changes into an oval area 71. A center point of the semi circle 69 of the elliptical through opening 64 coincides in the fitted and thus centered state with the axis of rotation 36 of the shaft 24. The part of the through opening 64 shown at the bottom (inside which runs the axis of rotation 36) has a radially inwardly extending bead 66 which is coaxial with the axis of rotation 36 or shaft 24. The bead 66 is narrower, seen in the axial direction, than the thickness of the plate 54. This results in the formation of a ring step 68. The ring step 68 is directed toward the rotor 26. The ring step 68 serves to receive a guide section 70 of the shaft 24. The guide section 70 is formed by a rotationally symmetrical thickened area behind a groove on the shaft 24.

With this design, when assembling the delivery device 10 the shaft 24 with the rotor 26 fixed for entrainment thereon is pushed through the through opening 64 in the plate 54 and through the through bore 22 in the housing part 16. First the shaft 24 is pushed through the plate 54 and the shaped features 68 and 70 come into engagement. Then the shaft 24 is pushed into the through bore 22 and the plate 54 is centered by the pins 58. The guide section 70 then comes to rest in the ring step 68 of the plate 54. Since the plate 54 lies flat against the surface 34 of the housing part 16 with its surface 62 a definite axial position of the entire shaft 24 is reached when the guide section 70 engages in the ring step 68. Through high-precision fine machining of the plate 54, when the guide section 70 engages in the ring step 68 a reproducible positioning can be achieved which can be defined with precision. The plate 54 thus undertakes the axial positioning and fixing of the shaft 24 in a simple manner.

The plate 54 furthermore has two through openings 72 arranged diametrically opposite relative to the axis of rotation 36 and in fluid communication with the ducts 38 in the housing part 16. The through openings 72 form together with a spacer ring 100 the so-called suction kidneys of the delivery device 10.

Furthermore the plate 54 has two pocket-like recesses 74 likewise arranged diametrically opposite relative to the axis of rotation 36. These recesses 74 are open to the surface 60 and to a circumference 76 of the plate 54. A pressure collecting chamber 78 (FIG. 2) of the delivery device 10 is in communication with the pockets 74. The recesses 74 form together with the spacer ring 100 so-called pressure kidneys of the delivery device 10. The pockets 74 have so-called damping grooves 79 which extend from the pockets 74 opposite to the direction of rotation of the rotor 26.

Figure 3:
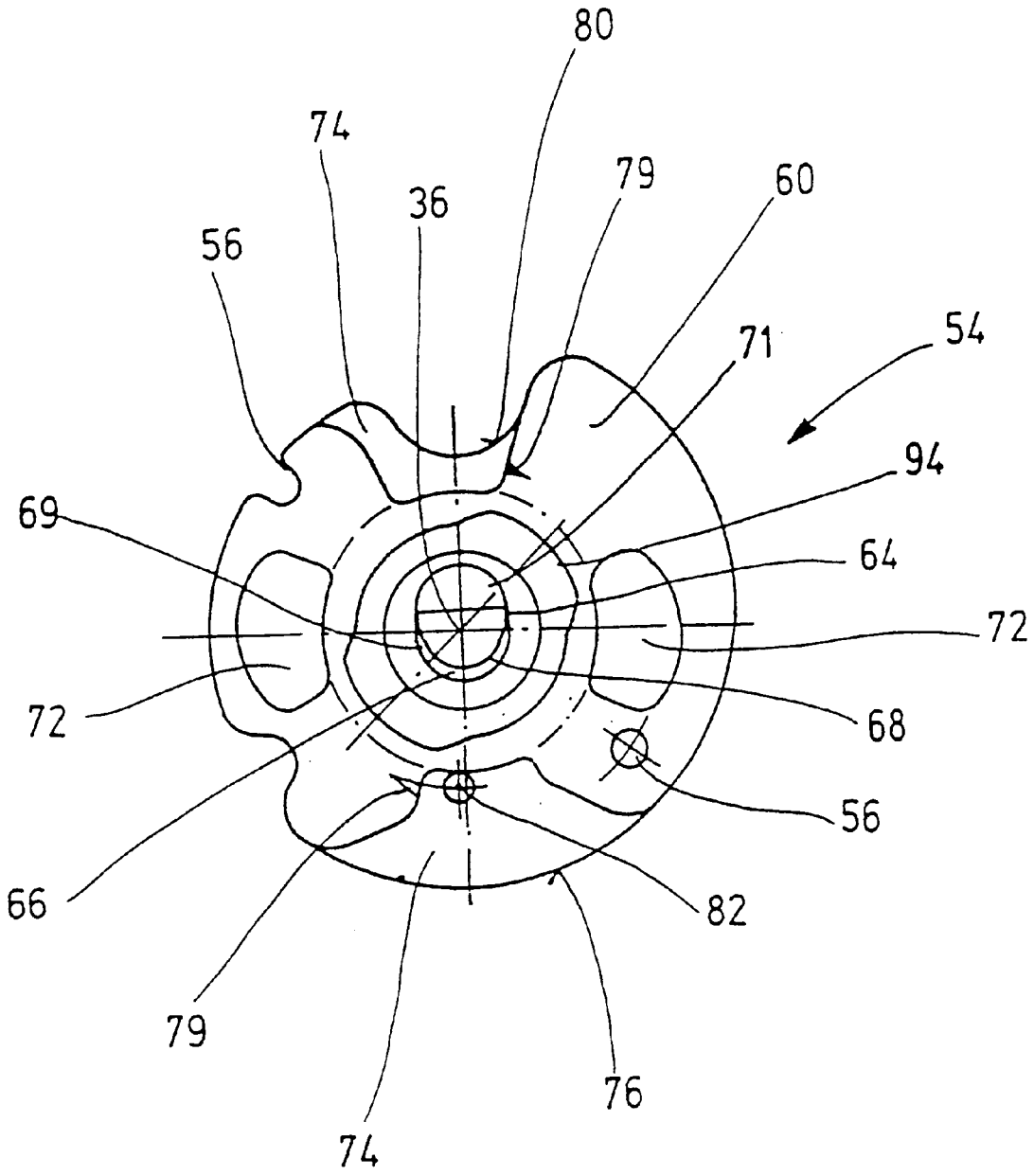
FIG. 3 is a plan view of a control plate.

The upper pocket 74 in the illustration of FIG. 3 has on the circumferential line 76 an indentation 80 through which the pressure collecting chamber 78 (FIG. 2) communicates with the flow regulating valve 42.

The lower pocket 74 has a through opening 82 which communicates with the variable main flow throttle 50 and forms with the piston chamber thereof a closed pressure chamber which cannot be passed through.

The through opening 64 of the plate 54 is furthermore surrounded by a ring groove 94, a so-called under vane groove, which opens towards the surface 60 and past which the undersides of the vane in the rotor run. It is possible to bias the vanes, which are mounted in the rotor so as to move radially outwards, with a radially outwardly directed force which emanates from the medium being delivered and assists the vanes in sliding out against the spacer ring 100.

It is clear that the plate 54 undertakes in addition to the axial positioning of the shaft 24 also the hydraulic control functions of the delivery device 10, in that on the one hand the required pressure connections are made with the channels mounted in the housing part 16 and connected to the suction connection 28 or pressure connection 32, and on the other side the different pressure regions of the delivery device 10 are sealed from each other through the plate 54. Because the plate 54 fits tight against the surface 34 of the housing part 16, the suction regions and the pressure regions are separated from each other. Furthermore the side 62 of the plate 54 seals on one side from each other the bores 40, 44 and 48 which receive the flow regulating valve 42, the pressure restricting valve 46 and the main flow throttle 50, as well as the channels 38, the control groove 52 and the through opening 22 receiving the shaft 24, and more particularly at the point of highest pressure guides the pressure through the through opening 82 to an active face of the main flow throttle 50 (surface on the piston) whereby the pressure chamber associated with the active face is not traversed and therefore the maximum pressure is not diminished.

The plate 54 thus forms a multi-functional component part of the delivery device 10 which through the formation of the through openings 72 (suction kidneys), the pockets 74 (pressure kidneys) as well as the damping grooves 79, undertakes the hydraulic control function of the delivery device 10. Furthermore the plate 54 acts as a universal sealing element by means of which the different pressure regions of the delivery device 10 can be sealed from each other. Furthermore at the same time an in particular axial positioning of the shaft 24 of the delivery device 10 is fixed. The sealing action of the plate 54 takes place hydraulically, that is during operation of the delivery device 10 the pump pressure presses the plate 54 against the housing part 16, through a rear pressure plate 86 and the ring 100, so that the surfaces 62 of the plate 54 and the surface 34 of the housing part 16 sealingly adjoin one another.

This sealing force is applied through a pressure plate 86 (FIG. 2) to the ring 100 and through this to the plate 54. The side of the pressure plate 86 remote from the rotor 26 is connected to the pressure collecting chamber 78 so that the pump pressure prevailing in the pressure collecting chamber 78 presses the pressure plate 86 axially against the ring 100 and presses the ring 100 against the plate 54. A rotational lock of the pressure plate 86, ring 100 and plate 54 is achieved through the fixing pin 58 which passes through the plate 54 and engages in a recess 88 of the housing part 16 on one side, in a bore 102 of the ring 100 and a recess 90 of the pressure plate 86 on the other side. In FIG. 2 a flow divider pin 92 can also be seen which divides the impact stream of the flow regulating valve-42 into two partial streams into the ducts 38.

Figure 4:
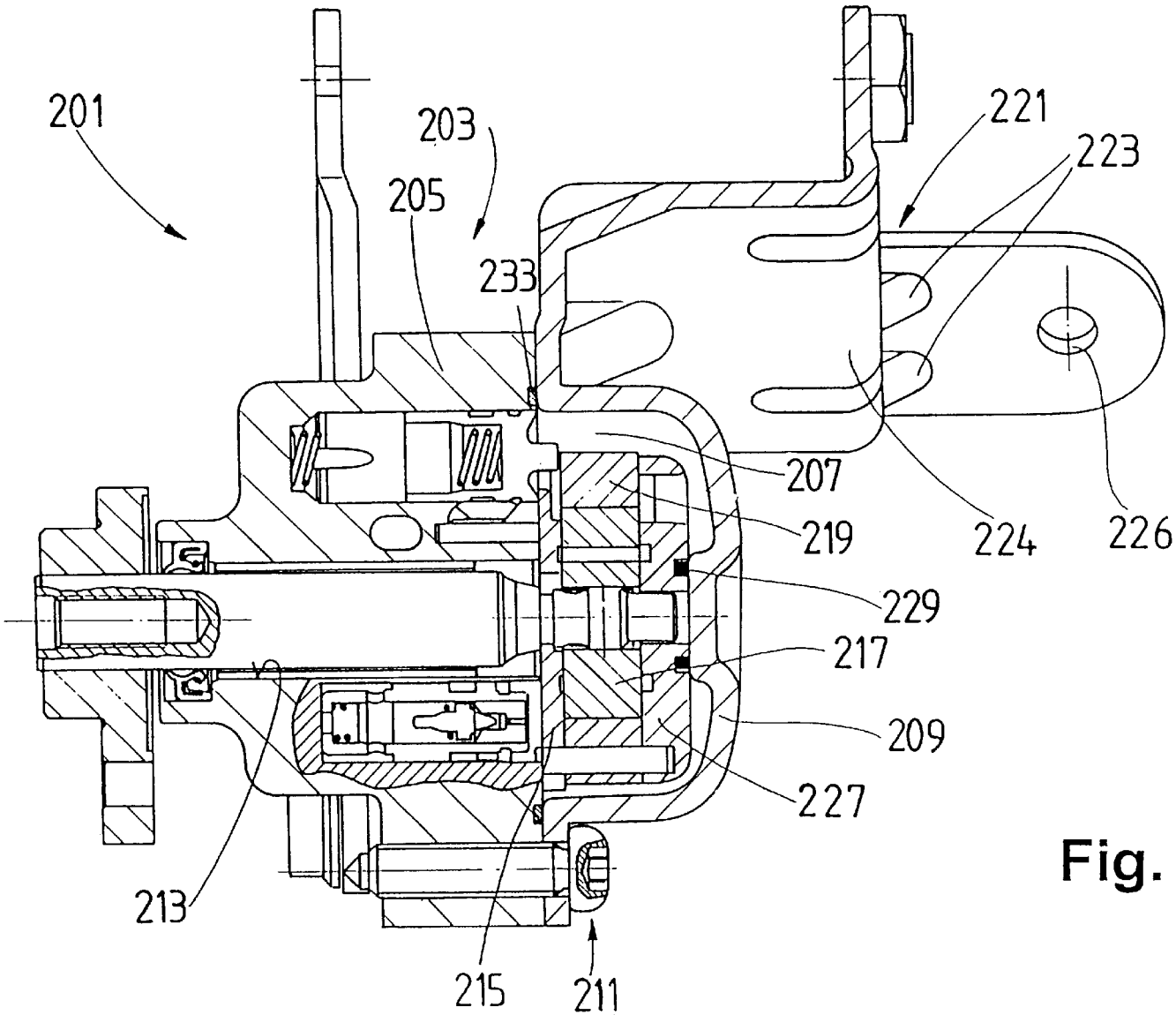
FIG. 4 is a sectional view through the delivery device.

FIG. 4 shows a sectional view through an embodiment of a hydraulic delivery device 201, which comprises a housing 203 with a first housing part 205 which can be closed by a cover 209, here formed pot-shaped, to create a pump chamber 207. The cover 209 is detachably fixed by means of several fasteners of which only the fastening means 211 can be seen in the illustration according to this Figure. The fastener 211 is here formed by a screw which engages through a full-length opening in the cover 209 and is screwed into a threaded bore in the first housing part 205.

A through opening 213 is formed in the first housing part 205 and serves to receive a shaft 214 which can be biased with torque and which is part of a displacement unit. A rotor 217 is attached rotationally secured to the end of the shaft 214 shown on the right in this figure and projecting beyond the first housing part 205. In the following details are only provided of the design and function of the cover 209.

The cover 209 is connected in one piece to a holder 221 which serves to fix the hydraulic delivery device 201 in the installation position provided for same, for example inside the engine compartment of a vehicle. The holder 221 in this embodiment consist of a relatively thin-walled element 224 which is angled at several places or has an angled contour. In order to increase the rigidity of the holder 221 several swages 223 are provided which are arranged in the transition regions between two (for example) angled surfaces of the element 224 extending at an angle to each other, and are preferably pressed into these surfaces. In order to increase the rigidity of the cover itself against sagging through the pressure prevailing on the inside, angled edges are provided in the regions between the screws 211. In this embodiment to fix the holder 221 in its installation area a through bore 226 is provided in the holder 221 through which a fastener (not shown), such as for example a screw, is passed. The structural design of the holder 221 is particularly dependent on the installation space provided for the hydraulic delivery device. The design of the holder can be adapted to the parts or fittings adjoining the installation space. Because a modular unit is produced by the integral connection between the cover 209 and the holder 221 it is possible to dispense with additional fasteners for the holder 221, such as are required with the known delivery device for fixing the holder on the cover, so that the costs for the hydraulic delivery device can be reduced and its assembly can be simplified.

With the preferred embodiment the cover 209 and the holder 221 consist of a sheet metal which may be, for example, steel, aluminum or aluminum alloy. The one-piece design of the cover 209 and the holder 221 is preferably produced by a deep drawing process wherein depending on the structural design of the cover or holder these two parts can be made in one or more steps from metal sheet. When selecting the material for the cover and holder it should be noted that when the sheet metal is stainless steel after the deep drawing process preferably no more surface finishing is required whilst sheet metal plates made of corrosive steel have to be chromium plated or Zn—Ni-plated. With a steel cover made by the deep drawing process it is particularly advantageous that the volumetric amount of material is less than for example with a pressure cast aluminum cover and therefore despite the high specific weight of steel the weight and where appropriate the space required by the cover are lower.

As can be seen from FIG. 4, the rotor 217 is mounted between two plates 215 and 227 which are also called pressure plates. The plate 227 is in the assembled state of the cover 209 pressed by means of a combi-seal 229 against a spacer ring 219, and the spacer ring 219 is supported in turn on the plate 215 adjoining the first housing part 205. The cover 209 thus applies an axial force on the displacement unit which is thereby held together and sealed. Between the cover 209 (which adjoins the plate 227 by a projection protruding in the central area in the direction of the displacement unit), and the plate 227 is a first seal 229 which is mounted in an annular groove formed in the plate 227. The seal 229 is compressed in the assembled state of the cover 209.

The pot-shaped cover 209 and the first housing part 205 form in the area of the displacement unit a pressure collecting chamber 207 which is sealed from the surrounding area by a second seal 233. The seal 233 is mounted in an annular groove formed here in the first housing part 205, and is compressed in the assembled state of the cover 209.

It is clear from all of this that the cover 209 is a multi-functional component part which fulfils several important functions of the hydraulic delivery device 201. Through the integral connection between the cover and holder it is possible to produce a compact delivery device with a reduced weight. This can be used with advantage for example in connection with power steering devices and braking devices or the like provided in vehicles. By omitting a screw connection for fixing the holder on the cover the latter takes up a much smaller structural space.

The most significant result from the invention for the cover is that also for example without an integrated holder the cover made as a deep drawn part from sheet steel is lighter than a pressure die-cast aluminum cover since the steel plate can be made thin-walled and the rigidity against distortion through high internal pressures is reached by reinforcements such as angled edges. In addition the pressure chamber 207 is larger for better flow and thus flow losses are reduced and the degree of efficiency is improved. These advantages remain even when screwing on a deep-drawn sheet metal holder which then engages for example by an indented additional "lug" into a hole at the edge of the deep drawn cover so that an anti-rotation lock is produced.

Figure 5:
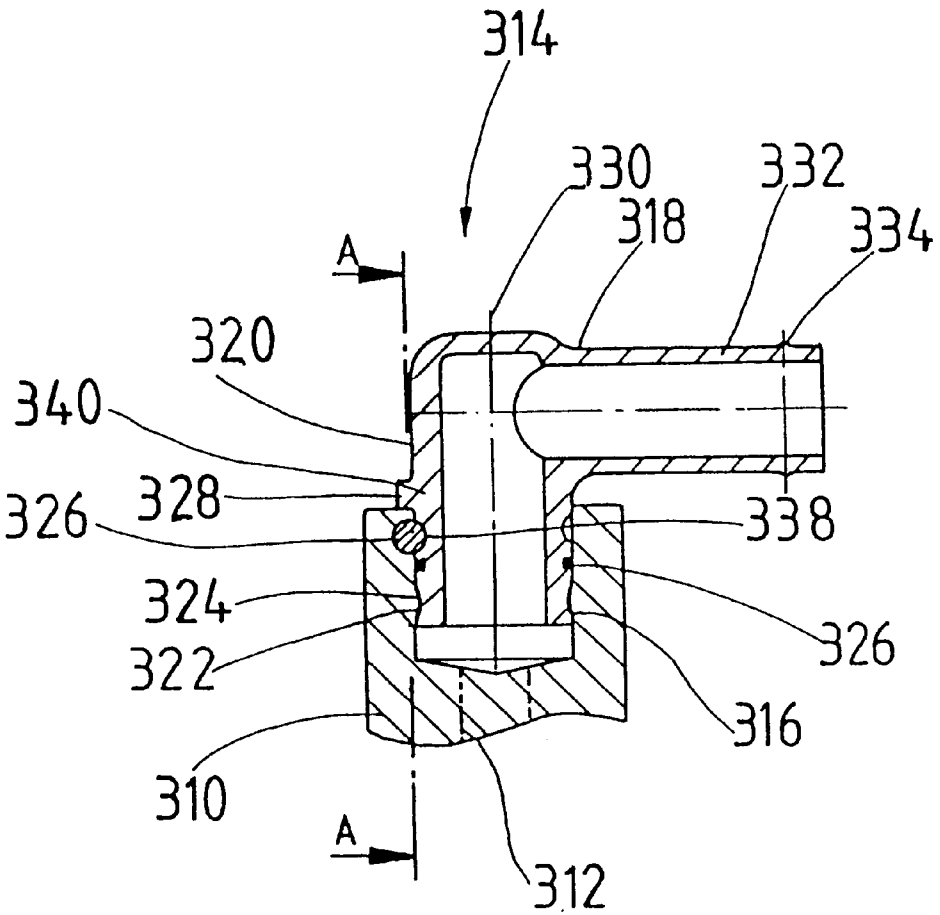
FIG. 5 is a longitudinal sectional view through a part of the hydraulic delivery device.

FIG. 5 shows a section of the housing 310 of a hydraulic delivery device. Inside the housing 310 is mounted the displacement unit (not shown) which is connected to a suction connection 314 through a bore 312 which is only indicated. The bore 312 opens into a blind bore 316, for example at the bottom of the blind bore 316. A pipe elbow 318 has a fastening flange 320 which engages in the blind bore 316. An outer diameter of the fastening flange 320 corresponds substantially to the inner diameter of the blind bore 316 so that it can be pushed free of play right down to the bottom of the bore 316. The bore 316 has an annular bead 322 which projects radially into the bore 316, and the flange 320 of the pipe elbow 318 has a circumferential groove 324 corresponding to the bead 322 so that the pipe elbow 318 engages with its circumferential groove 324 into the annular bead 322 when axially inserted into the blind bore 316. A sealing device 326 such as for example an O-ring is mounted between the pipe elbow 318 and the housing 310. A shoulder 328 extends from the flange 320 to serve as a stop for the insertion of the pipe elbow 318. This is pushed axially so far into the blind opening 316 until the shoulder 328 abuts the housing 310 whereby the ring bead 322 engages into the ring groove 324 at the same time. In this position the pipe elbow 318 can be rotated freely about a rotary axis 330. Through the snap connection between the ring bead 322 and the ring groove 324 the pipe elbow 318 is fixed axially but not yet radially.

In this pre-assembled state the hydraulic delivery device is fitted, for example flanged onto an engine block of an internal combustion engine of a motor vehicle. To produce a connection between the hydraulic delivery device and a tank (not shown) which contains for example hydraulic oil, a connecting hose (likewise not shown) is provided which can be pushed over a spigot 332 of the pipe elbow 318. The spigot 322 has a radially outwardly projecting ring bead 334 which serves to fix a connecting hose. In addition the connecting hose can be secured by a tension clip or the like. Through the radial mobility of the pipe elbow 318 in the bore 316 it is possible to select the optimum orientation of the pipe elbow 318 so that the connecting hose to the tank can be pushed onto the spigot 332 without bending.

A bore 336 is formed in the housing 310 and its circumferential line intersects the internal surface of the blind bore 316. The bore 336 runs at an angle of 900 to the axis of rotation 330 of the pipe elbow 318. The bore 336 is placed so that its central axis 338 lies outside of the blind bore 316 and thus within the housing 310. The circumferential surface of the bore 336 intersects the internal surface of the blind bore 316 along a circular line which extends along less than 1800 of arc. The bore 336 is mounted above the seal 326 so that the bore 336 is sealed from the bore 312.

After inserting the pipe elbow 318 into the blind bore 316 the bore 336 is overlapped by a wall 340 of the flange 320. The thickness of the wall 340 and/or a diameter of the bore 336 is selected so that the circumferential surface of the bore 336 when the pipe elbow 318 is inserted only intersects the wall 340 in areas, that is touches on same.

After the connecting hose to the tank has been fitted as already explained and the pipe elbow 318 aligned, a fastener 342 is introduced into the bore 336, as will be explained in further detail with reference to FIG. 6.

Figure 6:
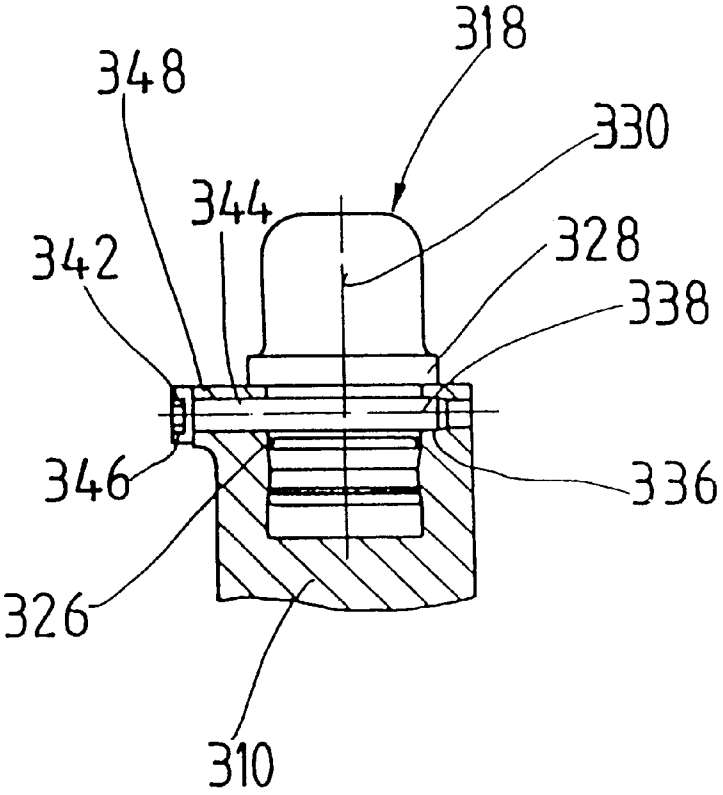
FIG. 6 is a longitudinal sectional view turned 90 relative to the longitudinal section according to FIG. 5.

FIG. 6 shows a sectional view along the line A—A of FIG. 5 wherein the same parts are provided with the same reference numerals as in FIG. 5 and will not be explained in further detail. The fastener 342 is formed for example as a screw with self-tapping thread 344. When screwing in the screw the thread 344 cuts into the material of the wall 340 of the flange 320. The pipe elbow 318 preferably consists of a plastics material so that the self-tapping of the thread 344 is possible without the need for applying much force, for example by means of a screw driver or the like. The screw is screwed so far into the bore 336 until a screw head 346 adjoins a bearing flange 348 of the housing 310. Through the self tapping thread 344 the screw is inserted and automatically locked in the bore 336.

The thread 344 has dug into the flange 320 corresponding to its pitch so that the pipe elbow 318 is secured both against axially coming out of the blind bore 316 and turning radially about the axis of rotation 330. Thus at the end of assembly, subsequent turning of the pipe elbow 318 inside the blind bore 316 is prevented. Any vibrations impinging thereon can thus not cause the pipe elbow 318 to change its position. The flange 332 of the pipe elbow 318 thus remains in its position already occupied so that the kink-free connection between the flange 332 and a connecting hose remains throughout the use of the hydraulic delivery device.

Figure 7A:
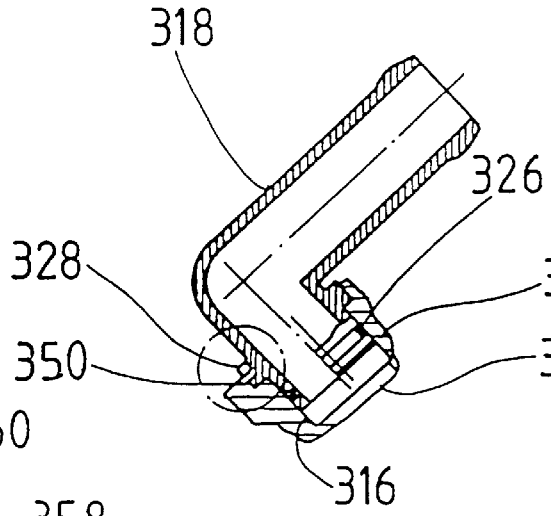
FIGS. 7*a*, 7*b* and 7*c* are views of a connection between a pipe fitting and a housing in a further variation.
Figure 7B:
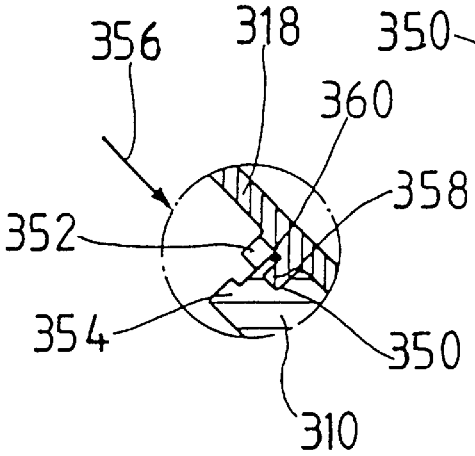
Figure 7C:
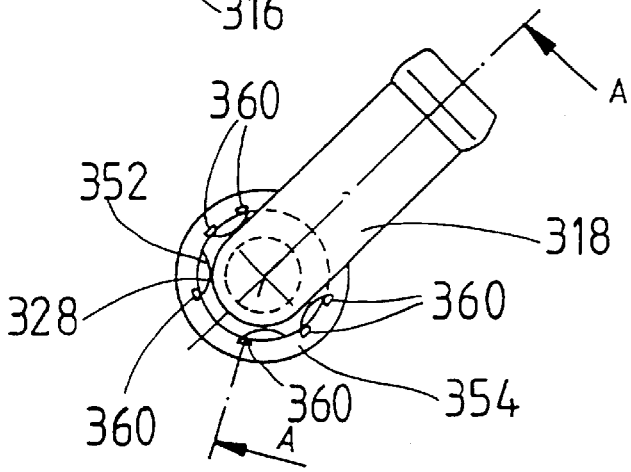

FIGS. 7*a* to 7*c* show a further variation of the axial and radial fixing of the pipe elbow 318 in the blind bore 316 of the housing 310. FIG. 7*a* shows a longitudinal sectional view through the connecting point between the pipe elbow 318 and the housing 310. The collar 328 of the pipe elbow 318 hereby lies in an annular groove 350 of the housing 310. FIG. 7*b* shows an enlarged view of this area. In FIG. 7*b* it can be seen that the collar 328 has at least one recess 352 which—as shown further in plan view in FIG. 7*c*—extends over a certain angular area of the collar 328. The recesses 352 are arranged for example symmetrically around the circumference of the collar 328 and are formed like circle segments. The depth of each recess 352 is selected so that when the collar 328 engages in the annular groove 350 a bead 354 of the housing 310is mounted above a bottom of the recess 352.

The pipe elbow 318 is fixed by applying a force to the bead 354 of the housing 310 through a tool (not shown), such as for example a ram, in the direction of the arrow 356 indicated in FIG. 7*b*. The force is such that the material of the bead 354 in the area of the recesses 352 of the pipe elbow 318 is plastically displaced into the recesses 352.

This results in the formation of an undercut section 358 which is overlapped by the area 360 of the displaced material of the bead 354. This undercut section 358 leads as a result of the design of the recesses 352 (plan view in FIG. 7*c*) to a radial fixing of the pipe elbow 318 and in addition to an axial securing of the pipe elbow 318.

Since a relatively thin-walled section 360 of the material of the bead 354 is displaced, this displacement can take place for example after the hydraulic delivery device 310 has been installed in a motor vehicle so that the pipe elbow 318 can be first positioned and then secured.

Obviously it is also possible to carry out an axial and radial fixing of the pipe elbow 18 either according to the embodiment shown in FIGS. 5 and 6 or according to the embodiment shown in FIG. 7 before final fitting in the motor vehicle.

The pipe elbow 318 preferably consists of a plastics material and can be made by injection other plastics molding processes or the like. Particularly suitable plastics are for example polyimide with a 10% proportion of glass fibers or polyamide with a glass fibre proportion of between 30 to and 60%. The pipe elbow 318 hereby achieves the required strength which guarantees on the one hand the penetration of the self-tapping screw 336 and on the other the caulking of the bead 354 of the housing 310 without impairing the strength and tightness of the plastics elbow 318.

Figure 8:
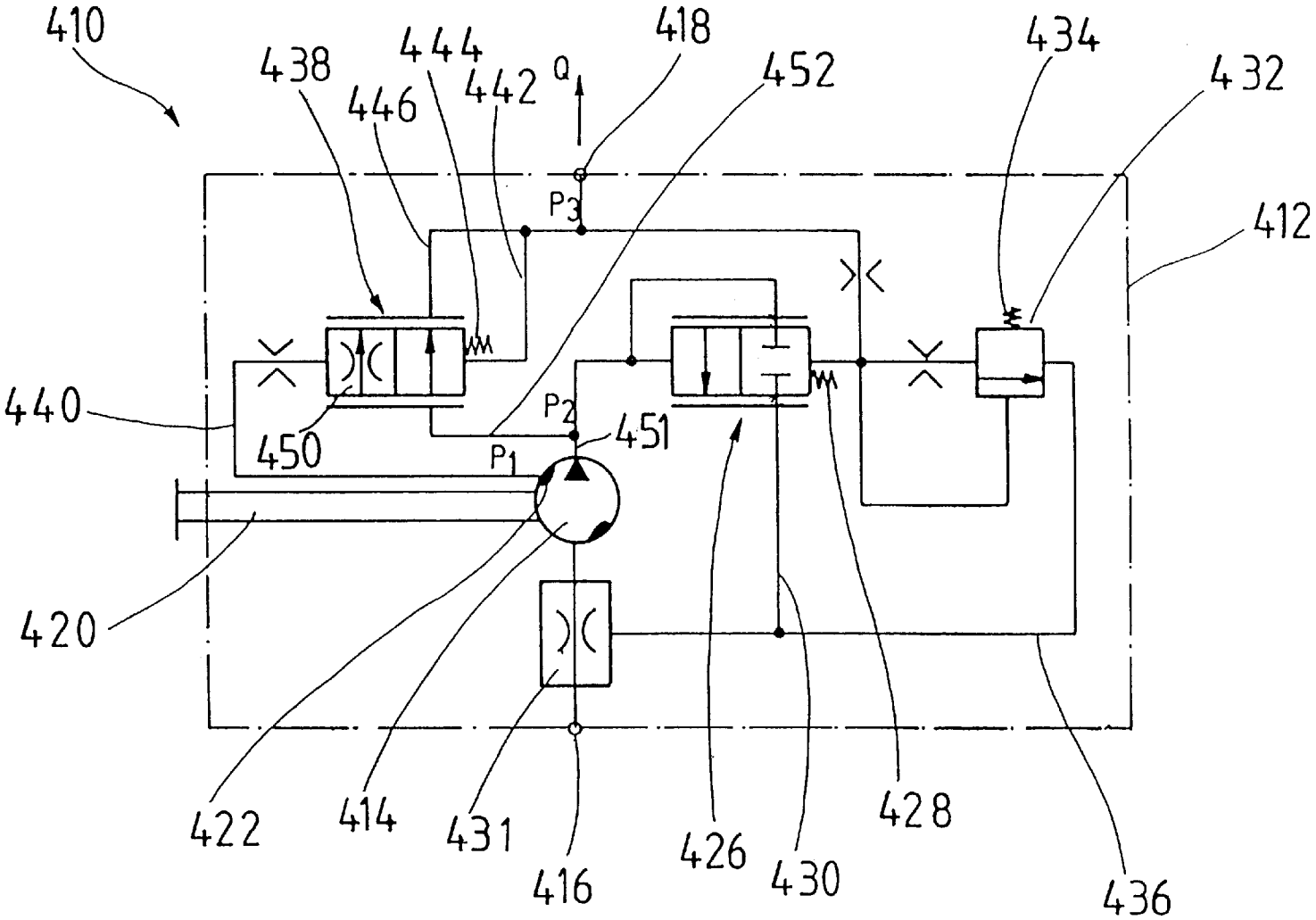
FIG. 8 is an equivalent circuit diagram of the hydraulic delivery device.

FIG. 8 shows an equivalent block circuit diagram of a hydraulic delivery device 410. The delivery device 410 can be for example a vane pump, a locked vane pump, a rotary piston pump or the like. The delivery device 410 comprises a displacement unit 414 mounted in a housing 412 and by means of which a medium, such as a hydraulic oil, can be delivered from a suction connection 416 to a pressure connection 418. The suction connection 416 is connected for example to a tank and the pressure connection 418 is connected to a consumer, for example a power steering unit of a motor vehicle. A rotor of the displacement unit 414 is drivable for example through traction means 420, shown here, (for example a belt drive), which in turn can be driven by an internal combustion engine of the motor vehicle. The operating speed of the delivery device 410 is set according to the speed of the internal combustion engine.

Through the rotating displacement unit 414, pump chambers are formed with changing volumes through which the medium is sucked in by the suction connection 416 and discharged through a pressure increase at the pressure connection 418. A volume flow Q is hereby set in dependence on the drive speed of the delivery device 10. A pressure P1 is set in a pressure cell 422, here only indicated, which is mounted in the region which lies inside the delivery device 10 in front of a pressure kidney (before the outlet of the medium into the pressure collecting chamber). A discharge pressure P2 is set in a pressure collecting chamber 451 of the delivery device 410 into which for example several pressure cells 422 can pump. The pressure collecting chamber 451 and therefore the discharge pressure P2 are immediately downstream of the displacement unit 414. Finally, a consumer pressure P3 is set at the pressure connecting 418 corresponding to a volume flow Q which leads to an attached consumer.

With a relatively high speed of the delivery device 410, without a regulating valve a volume flow Q would result at the pressure connection 418 which lies above a maximum volume flow Q required by the consumer. In order to be able to regulate down this volume flow Q a flow regulating valve 426 is provided whose valve spool can be biased with discharge pressure P2 on one side and with the consumer pressure P3 on the other side. A valve spool of the flow regulating valve 426 is moved against the force of a spring element 428 according to a differential pressure between the discharge pressure P2 and the consumer pressure p3 until an outflow connection 430 is released into the suction region of the delivery device 410. The medium which is under the discharge pressure P2 upstream of the flow regulating valve 426 thus flows back into the suction region of the delivery device 410. The medium passes an injector 431 by means of which the medium standing under the exit pressure is drawn out of the tank (not shown) through the medium forming a jet with high speed, so that a particularly good loading of the suction region of the delivery device 410 is produced. A spring chamber of the flow regulating valve 426 is additionally coupled with a pressure relief valve 432 so that when the consumer pressure P3 rises above a predeterminable maximum valve, the pressure relief valve 432 opens against the force of a spring element 434 and opens an additional connection 436 to the suction region of the delivery device 410.

A main flow throttle 438 is mounted in a connection between the pressure collecting chamber of the deliver device 410 in which the discharge pressure P2 exists, and the pressure connection 418 of the delivery device 410 where the consumer pressure P3 exists. The main flow throttle 438 is adjustable in a variable manner and can be biased on one side with the pressure P1 of the pressure cell 422 through a connecting pipe 440 and on the other side with the consumer pressure P3 through a connecting pipe 442. A valve spool 450 of the variable main flow throttle 438 is displaced against the force of a spring element 444 corresponding to a differential pressure set between the pressure P1 and the pressure P3 so that the cross-sectional area of a pressure channel 446 which connects the pressure connecting chamber of the delivery device 410 to the pressure connecting 418, can be changed. The volume flow Q to the consumer can be influenced, more particularly lowered, corresponding to this variable through-flow cross-sectional area, independently of the flow regulating valve 426. Thus in conjunction with a flow regulating valve 426 it is possible in practice to achieve a fine adjustment or additional change (from when higher/lower and how much higher/lower) of the volume flow Q. Since the main flow throttle 438 is biased on the one side by the pressure P1 in the pressure cell 422 and on the other side by the consumer pressure P3 the change in the free cross-sectional area of the main flow throttle 438 takes place practically independently of the discharge pressure P2 of the delivery device 410.

Figure 9:
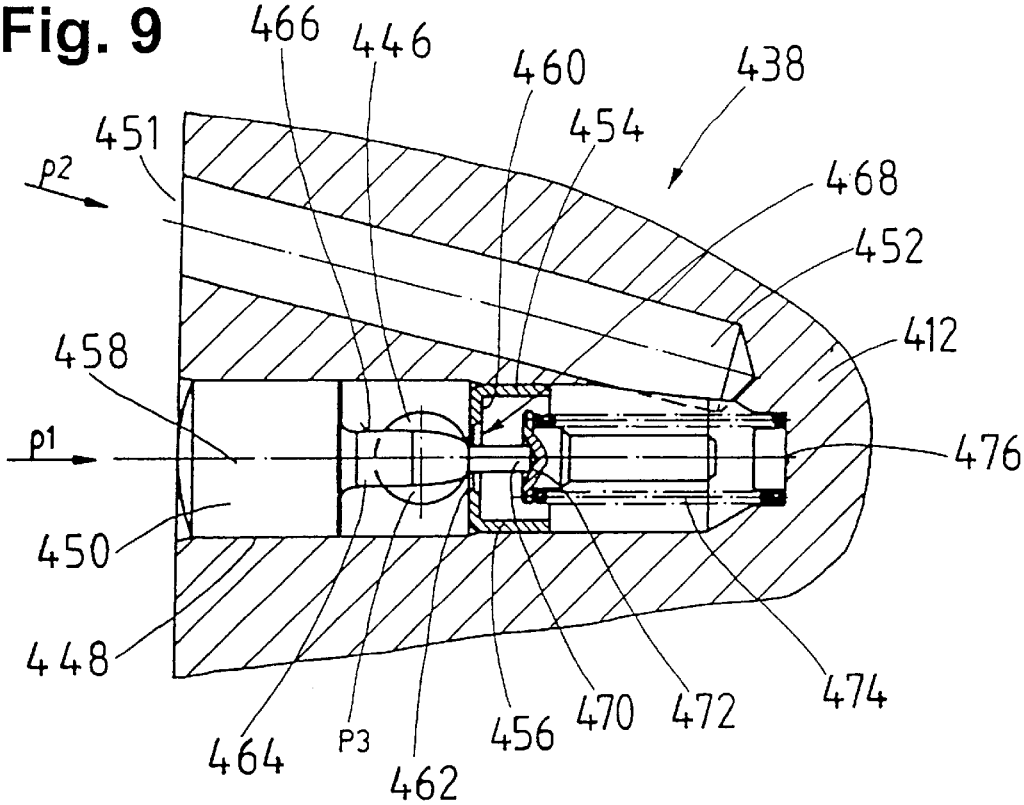
FIG. 9 shows a first embodiment of a variable main flow throttle.

FIG. 9 shows in a sectional view a design possibility for a variable main flow throttle 438. This has a valve spool 450 which is axially displaceable in a bore 448 of the housing 412 of the delivery device 410. An outer diameter of the valve piston 450 corresponds substantially to an inner diameter of the bore 448 so that this is guided sealingly in the bore 448. The pressure channel 446 opens into the bore 448 on one side and a pressure channel 452 through which the medium delivered by the displacement unit 414 and standing under the pressure P2 is delivered to the pressure channel 446 and thus to the pressure connection 418 of the delivery device 410 opens into the bore on the other side. Inside the bore 448 is an orifice unit 454 which is in the form of a pot-shaped sleeve 456 whose base 460, running radially to a longitudinal axis 458 of the bore 448, has a through opening or orifice 462. A regulating pin 464 which is fixedly connected to the valve piston 458 (and may be formed integral therewith) extends through the opening 462. The regulating pin 464 is rotationally symmetrical and has an outer contour 466 which tapers conically towards the opening 462. The maximum diameter of the regulating pin 464 is smaller than the diameter of the opening 462 so that a variable free through flow cross-sectional area 468 (ring gap) is set between the regulating pin 464 and the opening 462 corresponding to the conicity of the contour 466 and position of the regulating pin 464.

One end 470 of the regulating pin 464 is supported on a spring plate 472 which is displaceable against the force of a spring element 474 in the direction of a base 476 of the bore 448. The spring element 474 is supported on the bottom 476 of the bore 448. The orifice unit 454 is mounted inside the bore 448 between the pressure channels 446 and 452 opening into the bore 448.

The main flow throttle 438 illustrated in FIG. 9 functions as follows:

The valve piston 450 is biased on one side with the pressure P1 which prevails in the pressure cell 422 of the displacement unit 414. This pressure P1 is dependent on speed, that is as the speed of the delivery device rises so the pressure P1 rises on the other side the valve piston 450 is biased substantially with the consumer pressure P3 through the pressure channel 446 and by the force of the spring element 474. The force of the spring element 474 is determined by a spring characteristic of the spring element 474. Thus a position of the valve piston 450 is set substantially in dependence on a differential pressure between the pressures P1 and P3. As the speed of the delivery device 410 rises so that pressure P1 rises so that the valve piston 450 is displaced against the force of the spring element 474, to the right as seen in FIG. 9. The regulating pin 464 which is fixed to the valve piston 450 is displaced inside the opening 462 of the orifice unit 454. The through-flow cross-sectional area 468 inside the bore 448 is thus changed corresponding to the conicity of the contour 466, that is as the pressure P1 (and P2) rises, so P3 is somewhat reduced. The through flow cross-sectional area 468 between the pressure channels 452 and 446 is changed so that throttling of the volume flow Q occurs (FIG. 8). As the speed drops, so the pressure P1 is reduced so that the valve piston 450 is moved by the force of the spring element 474, to the left as seen in FIG. 9, so that the through-flow cross-sectional area 468 between the regulating pin 464 and the opening 462 is again increased.

The orifice unit 454 can be made for example from a sheet metal part or the like which is pressed into the bore 448. Through this pressed seat the orifice unit 454 can achieve a defined position which remains unchanged throughout the use of the delivery device 410. Thus overall it is possible to obtain a variable main flow throttle 438 by using few component parts which can be produced cost-effectively. By optimizing the contour 466 of the regulating pin 464 and adapting the spring force of the spring element 474 it is possible to set by means of the variable main flow throttle 438 any volume flow characteristic of the hydraulic delivery device 410 substantially independently of the discharge pressure P2 of the delivery device 410.

A further advantage is that the oil flow is not throttled through the spring but flows past this "on the outside".

Figure 10:
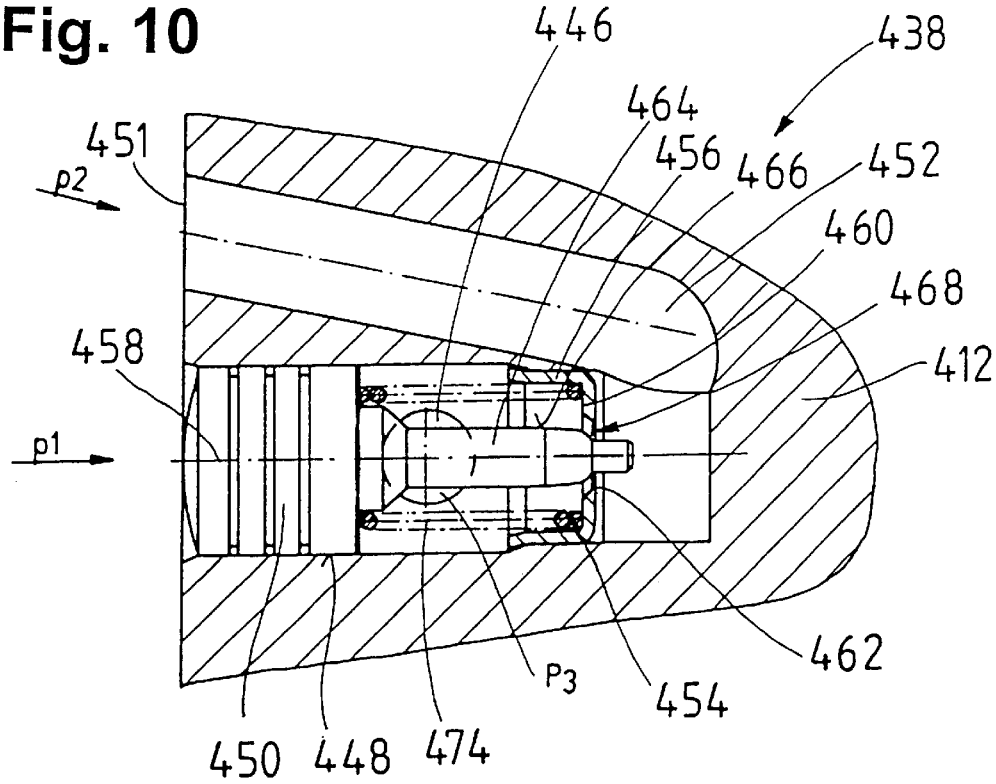
FIG. 10 shows a second embodiment of a variable main flow throttle.

FIG. 10 shows a further variation of a variable main flow throttle 438 wherein the same parts as in FIG. 9 are provided with the same reference numerals and will not be explained in further detail again. Thus reference is only made to the differences.

The orifice unit 454 is again formed as a press-in insert and is fixedly inserted in the bore 448. In contrast to the embodiment shown in FIG. 9, the spring element 474 is supported between the valve piston 450 and the bottom 460 of the orifice unit 454. The orifice unit 454 is to this end mounted in a position turned 1800 from the design in FIG. 9. Through the variation shown in FIG. 10 less installation space is required for the arrangement of the main flow throttle 438 compared to the embodiment shown in FIG. 9, but without impairing the regulating function of the main flow throttle 438. The volume flow through the pressure channel 452 to the pressure channel 446 is influenced through the variable free through-flow cross-sectional area 468 (annular gap) between the regulating pin 464 and the orifice unit opening 462. Action of the pressure P2 on the right-hand end of the regulating pin is negligible since this surface amounts to only 4% of the large surfaces and P2 is statically reduced through high flow speeds.

The patent claims filed with the application are proposed wordings without prejudice for obtaining wider patent protection. The applicant retains the right to claim further features disclosed up until now only in the description and/or drawings.

References used in the sub-claims refer to further designs of the subject of the main claim through the features of each relevant sub-claim; they are not to be regarded as dispensing with obtaining an independent subject protection for the features of the sub-claims referred to.

The subjects of these sub-claims however also form independent inventions which have a design independent of the subjects of the preceding claims.

The invention is also not restricted to the embodiments of the description. Rather numerous amendments and modifications are possible within the scope of the invention, particularly those variations, elements and combinations and/or materials which are inventive for example through combination or modification of individual features or elements or process steps contained in the drawings and described in connection with the general description and embodiments and claims and which through combinable features lead to a new subject or to new process steps or sequence of process steps insofar as these refer to manufacturing, test and work processes.

What is claimed is:

1. A hydraulic delivery device comprising a displacement unit which delivers a medium from a suction connection, standing under suction pressure, to a pressure connection which can be connected to a consumer and is under consumer pressure (P3), a flow control valve for adjusting or restricting a volume flow delivered by the displacement unit, the displacement unit further comprising a pressure collecting chamber that has a discharge pressure (P2), wherein the pressure collecting chamber of the displacement unit is connected to the pressure connection through a variable throttle device which is biased on one side by an internal pressure P1 of the displacement unit and on the other side by the consumer pressure P3 such that the variable throttle device operates substantially independently of the discharge pressure (P2) of the displacement unit.

2. The hydraulic delivery device according to claim 1, wherein the throttle device is a valve assembly which in dependence on a differential pressure between the consumer pressure (P3) and a pressure (P1) inside a pressure cell in front of a pressure kidney of the displacement unit varies a through-flow cross-sectional area of an orifice device in a pressure line between the pressure collecting chamber and the pressure connection.

3. The hydraulic delivery device according to claim 2, wherein the valve assembly has a valve spool mounted axially displaceable in a bore and which can be biased on one side with the pressure ($P_1$) of the pressure cell and on the other side with the consumer pressure ($P_3$) and the force of a spring element wherein a control device of the valve spool varies the free through-flow cross-sectional area in dependence on a differential pressure between the pressures ($P_1$) and ($P_3$).

4. The hydraulic delivery device according to claim 3, wherein the valve spool has a regulator pin which engages through a full-length opening of a fixed orifice device, and an outer contour of the regulator pin has in its area of movement in the area of the full-length opening a contour which changes in the axial direction.

5. The hydraulic delivery device according to claim 4, wherein the contour of the regulating pin changes in the direction of the through bore by tapering conically or widening out conically.

6. Hydraulic delivery device according to claim 4, wherein the orifice is formed in a sleeve pressed into the bore.

7. Hydraulic delivery device according to claim 4, wherein the regulator pin is supported on a spring plate on which the spring element engages which is supported on the other side on a base of the bore.

8. Hydraulic delivery device according to claim 4, wherein the spring element is supported on the valve piston on one side and on the orifice unit on the other.

9. A hydraulic delivery device comprising a displacement unit which delivers a medium from a suction connection, standing under suction pressure, to a pressure connection which can be connected to a consumer and is under consumer pressure (P3), a flow control valve for adjusting or restricting a volume flow delivered by the displacement unit, the displacement unit further comprising a pressure collecting chamber that has a discharge pressure (P2) and a pressure cell that operates at a pressure P1, wherein the pressure collecting chamber of the displacement unit is connected to the pressure connection through a variable throttle device which is biased on one side by the pressure P1 and on the other side by the consumer pressure P3 such that the variable throttle device operates substantially independently of the discharge pressure (P2) of the displacement unit.

10. The hydraulic delivery device according to claim 9, wherein the pressure cell is disposed in front of a pressure kidney of the displacement unit.

11. The hydraulic delivery device according to claim 9, wherein the throttle device is a valve assembly which in dependence on a differential pressure between the consumer pressure (P3) and the pressure P1 varies a through-flow cross-sectional area of an orifice device in a pressure line between the pressure collecting chamber and the pressure connection.

12. The hydraulic delivery device according to claim 11, wherein the valve assembly has a valve spool mounted axially displaceable in a bore and which can be biased on one side with the pressure P1 of the pressure cell and on the other side with the consumer pressure (P3) and the force of a spring element wherein a control device of the valve spool varies the free through-flow cross-sectional area in dependence on a differential pressure between the pressure P1 and the consumer pressure (P3).

13. The hydraulic delivery device according to claim 12, wherein the valve spool has a regulator pin which engages through a full-length opening of a fixed orifice device, and an outer contour of the regulator pin has in its area of movement, in the area of the full-length opening, a contour which changes in the axial direction.

14. The hydraulic delivery device according to claim 13, wherein the contour of the regulator pin changes in the direction of the through bore.

15. The hydraulic delivery device according to claim 14, wherein the contour changes by one-of tapering conically and widening out conically.

16. The hydraulic delivery device according to claim 13, wherein the orifice is formed in a sleeve pressed into the bore.

17. The hydraulic delivery device according to claim 13, wherein the regulator pin is supported on a spring plate on which the spring element engages which is supported on the other side on a base of the bore.

18. The hydraulic delivery device according to claim 13, wherein the spring element is supported on the valve piston on one side and on the orifice unit on the other.

19. The hydraulic delivery device according to claim 9, wherein the pressure cell is arranged in the displacement unit before an outlet of the medium into the pressure collecting chamber.

20. The hydraulic delivery device according to claim 9, including a first conduit extending between the pressure cell to the one side of the variable throttle device and a second conduit extending between the pressure connection and the other side of the variable throttle device, wherein the first conduit is under the pressure P1 and the second conduit is under the consumer pressure (P3).

* * * * *